United States Patent [19]

Young et al.

[11] 4,024,692

[45] May 24, 1977

[54] APPARATUS AND METHOD OF PACKAGING LARGE ITEMS

[75] Inventors: William E. Young, Atlantic Highlands; Robert O. Wolfelsperger, Fairfield; William R. Pasco, Cream Ridge, all of N.J.

[73] Assignee: William E. Young, Atlantic Highlands, N.J.

[22] Filed: Feb. 18, 1976

[21] Appl. No.: 658,991

[52] U.S. Cl. ..... 53/22 A; 53/28; 53/86; 53/112 A; 53/182 R

[51] Int. Cl.[2] ..... B65B 31/02; B65B 9/02

[58] Field of Search ..... 53/22 A, 22 B, 112 A, 53/112 B, 182, 28, 373, 95, 86

[56] References Cited

UNITED STATES PATENTS

| | | | |
|---|---|---|---|
| 2,676,440 | 4/1954 | Campbell | 53/86 X |
| 2,749,686 | 6/1956 | Lorenz et al. | 53/112 B X |
| 2,840,964 | 7/1958 | Kissling | 53/112 B X |
| 3,481,107 | 12/1969 | Andblad et al. | 53/182 X |
| 3,857,222 | 12/1974 | Grebe | 53/86 X |

*Primary Examiner*—Travis S. McGehee
*Attorney, Agent, or Firm*—Ralph R. Roberts

[57] ABSTRACT

This invention discloses a packaging apparatus, method and the resulting package for large size products such as subprimals of meat. The products to be packaged are characterized as often having irregular surfaces and voids which make sealing of the film without wrinkles very difficult, particularly after bringing to a condition of reduced pressure. There is shown apparatus for forming a drape of film from two rolls of film and into this drape of film is advanced the product to be packaged. This drape is formed into a tubular film around the product and with this tube open at both ends. Into these open ends of the tube are moved spreader probes or bars which operate as pairs and are moved away from one another by a pneumatic cylinder which is actuated by appropriate apparatus so that the spreader probes as they move apart cause the film in these ends to be brought to a narrow opening and under a slight stretch. This elongated opening is substantially equally spaced from a theoretical center line of the tubular film. With the probes moved to a condition for stretching the film, the encased product is brought to a vacuum chamber whereat the spreader probes are withdrawn from the ends of the package and while and when in this chamber the chamber and product are brought to a condition of reduced pressure. While still in the chamber and under the influence of reduced pressure the elongated ends of the tubular film are sealed so that these ends of film are sealed free of wrinkles. After sealing, the package and chamber are opened to the atmosphere to allow the film to tightly enclose the product. The package is then removed from the vacuum chamber. Large products when packaged by skin packaging apparatus tend to have the film overstretched. This occurs when the product is used to shape and mold a heated film. With the product pushed into the draped film and a tube formed by closing and sealing the rear of the drape, overstretching of the film is eliminated or minimized to tolerable levels so that the resulting package is absent weak portions of film.

17 Claims, 31 Drawing Figures

291
292
205
287
286
5a
5b
5c
276
259
285
281
221
219
211
277
267
265
283
279
263
241

APPARATUS AND METHOD OF PACKAGING LARGE ITEMS

BACKGROUND OF THE INVENTION

1. Field of the Invention

With reference to the classification of art as established in the United States Patent and Trademark Office the present invention is believed to be found in the general Class entitled, "Package Making" (Class 53) and in the subclasses thereunder entitled, "methods-with contents treating-vacuum or gas receptacle forming" (subclass 22A) and "with contents material treating — vacuum or inert atmosphere — includes container forming" (Subclass 112A).

2. Description of the Prior Art

The apparatus, the method of vacuum forming and packages formed while in a vacuum chamber are all well known. Film packaging of food products is particularly a well known and crowded art since todays fresh meat, produce and many frozen products are delivered to the stores in an already film packaged state. Toward that end and to the extent applicable to this type of package, reference is made to U.S. Pat. No. 3,491,504 as issued to W. E. YOUNG, etal. on Jan. 27, 1970 and to U.S. Pat. No. 3,686,822 as issued to WOLFEL-SPERGER on Aug. 29, 1972. In these and many other patents warmed film is drawn to and around the product by the influence of atmosphere as and after the package and contents have been brought to a condition of reduced pressure while in a vacuum chamber. In these patents and in other apparatus the sealing occurs within the chamber. Many skin packages overstretch the heated film drawn over the product. Automatic skin packaging of many products is less than satisfactory in producing sound packages.

In the present invention the problem of excess film, film which is not utilized in encasing the product, is solved by providing a double ended bag. After the product is positioned in the tubular film member, a pair of spreader probes are moved by pneumatic means away from each other to cause a narrow elongated opening to be formed at and in each end of the tubular film. These probes enter both ends of the tubular film. The spreader probes, as they move apart lightly, stretch each end opening and more-or-less center the openings with the center line of the tubular film. While the product encased in the tubular film is transported to a vacuum chamber the apart spreader probes are maintained in the tubular film. Prior to closing and evacuating the vacuum chamber the pair of spreader probes are withdrawn directly outward in order to maintain the elongated opening at each end of the film. This stretch maintains the opening while the chamber is closed and brought to a condition of reduced pressure. After the desired amount of reduced pressure is achieved, the elongated end portions of the film are sealed by sealing bar means. The chamber is then opened to atmospheric pressure and the vacuum packaged and sealed prodcut is removed from the vacuum chamber.

SUMMARY OF THE INVENTION

This invention may be summarized at least in part with reference to its objects. It is an object of this invention to provide, and it does provide, an apparatus for encasing a product in a tubular film. Into each of the open ends of the tubular film a pair of spreader probes is inserted and the spreader probes are moved apart to cause the open ends of the tubular film to be formed into elongated narrow openings. While in this condition the package is transported into a vacuum chamber wherein it is brought to a condition of reduced pressure and the ends of the film are sealed without wrinkling the film.

It is another object of this invention to provide, and it does provide, a method of encasing a product in a tubular film and while the product is in this tubular wrapping a pair of spreader probes are inserted into each end of the tubular film to a point near the product. The spreader probes move outwardly to bring each end of the tubular film into an elongated, slightly stretched, narrow opening condition. While in this condition the package is moved to a vacuum chamber whereat the probes are withdrawn from the film. The chamber is then closed and brought to a condition of reduced pressure. While in the chamber and under the influence of reduced pressure the ends of the film are sealed and the chamber is opened. The vacuum packaged product is then removed.

In brief, the apparatus of this invention provides for the forming of a drape of film preferably from above and below rolls of film which are joined at or above the product transport apparatus. The product to be wrapped is pushed into this drape. After a determined amount of advancement of the product into the drape is achieved, the product is stopped and the film trailing the product is sealed and cut to form a tubular bag around the product, the bag being open at both ends. Into each of the open ends of this tubular bag is inserted a pair of spreader probes, which probes are actuated by pneumatic cylinders. The spreader probes, as they are moved apart lightly, stretch each end opening causing the film ends to be formed into narrow openings under a determined stretch force. With the spreader probes still inserted into the ends of the tubular film, the encased product is moved to a vacuum chamber whereat both pairs of spreader probes are removed prior to the chamber being closed. The chamber and product are then brought to a condition of reduced pressure. While still in the chamber and under this condition of reduced pressure the elongated ends of the film along the previously established parallel extents are sealed together with the ends being free of wrinkles. After sealing the ends the chamber is opened to atmosphere and the vacuum sealed package is removed. In this apparatus and by this method the product when packaged does not overstretch the film in which it is encased. This condition of overstretching usually occurs when large products are packaged by skin packaging apparatus using the product to shape and form the warmed film.

The apparatus and method of this invention provides a unique packaged product. It is known to utilize a bag with an open end into which a product, often poultry, is placed and with a snorkel the bag is partly evacuated. A tie is used to close this end of the bag. It is also known to utilize a bag to enclose a product and to seal the open end with a heat seal. Such a package usually requires hand smoothing of the wrap to make it presentable and free of wrinkles. In the present invention the package even without being brought to a condition of reduced pressure presents a unique method and product. Both ends of the film bag are open and after the spreader probes stretch each end to a determined open condition the bag is closed by sealing bars. This results in a smooth package with the very minimum of wrinkles and surplus film around the product even in the absence of vacuum.

In addition to the above summary the following disclosure is detailed to insure adequacy and aid in understanding of the invention. This disclosure, however, is not intended to prejudice that purpose of a patent which is to cover each new inventive concept therein no matter how it may later be disguised by variations in form or additions of further improvements. For this reason there has been chosen a specific embodiment of the vacuum packaging apparatus as adopted for use with large products and showing a preferred means for forming elongated openings at each end of a tubular film. This specific embodiment has been chosen for the purposes of illustration and description as shown in the accompanying drawings wherein:

BRIEF DESCRIPTION OF THE DRAWINGS

In the following description and in the claims various details are identified by specific names for convenience. These names, however, are intended to be generic in their application. Corresponding reference characters refer to like members throughout the several figures of the drawings.

The drawings accompanying this specification diclose certain details of construction for the purpose of explanation but it should be understood that structural details may be modified in various respects without departure from the concept of the invention and that the invention may be incorporated in other structural forms than shown.

Figure 1:
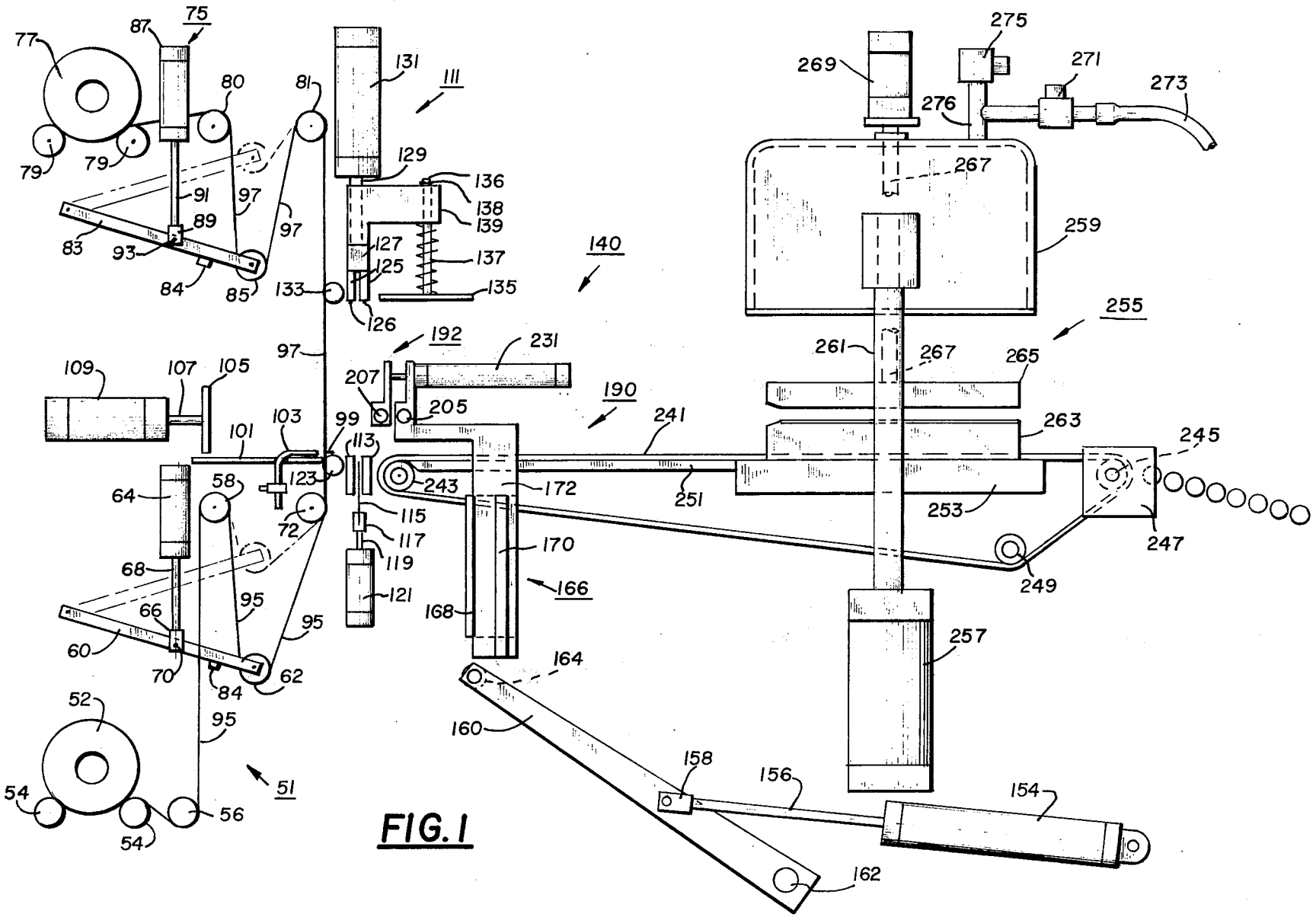
FIG. 1 represents a schematic side view of the wrapping and sealing apparatus prior to the presentation and insertion of the product into a formed drape of film.
Figure 2:
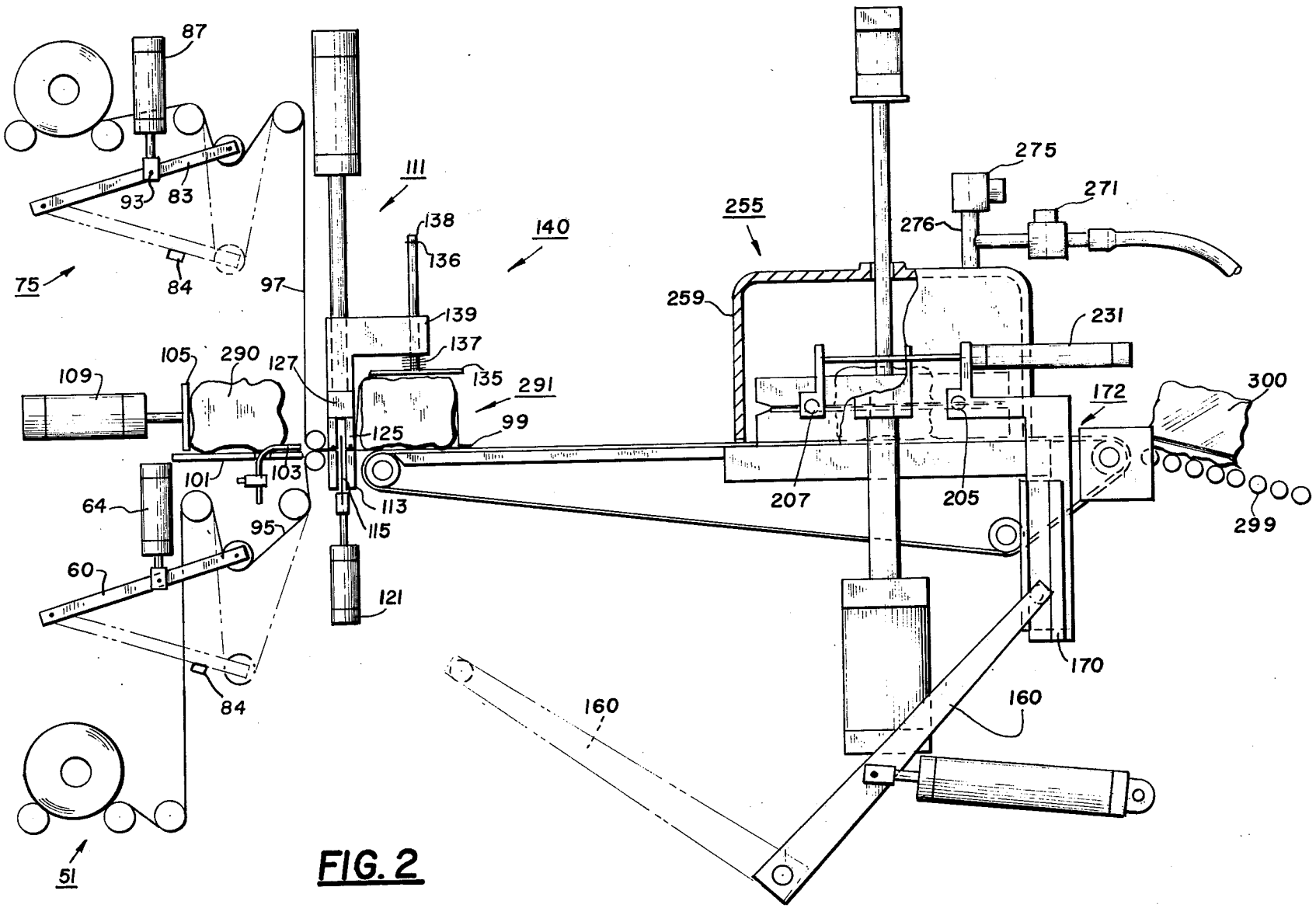
FIG. 2 represents a schematic side view of the apparatus as shown in FIG. 1 with the product shown in various positions of the package forming and sealing operation.

DESCRIPTION OF THE PREFERRED EMBODIMENT OF THE FILM DRAPE AND TRANSFER APPARATUS OF FIGS. 1 AND 2

Figure 3:
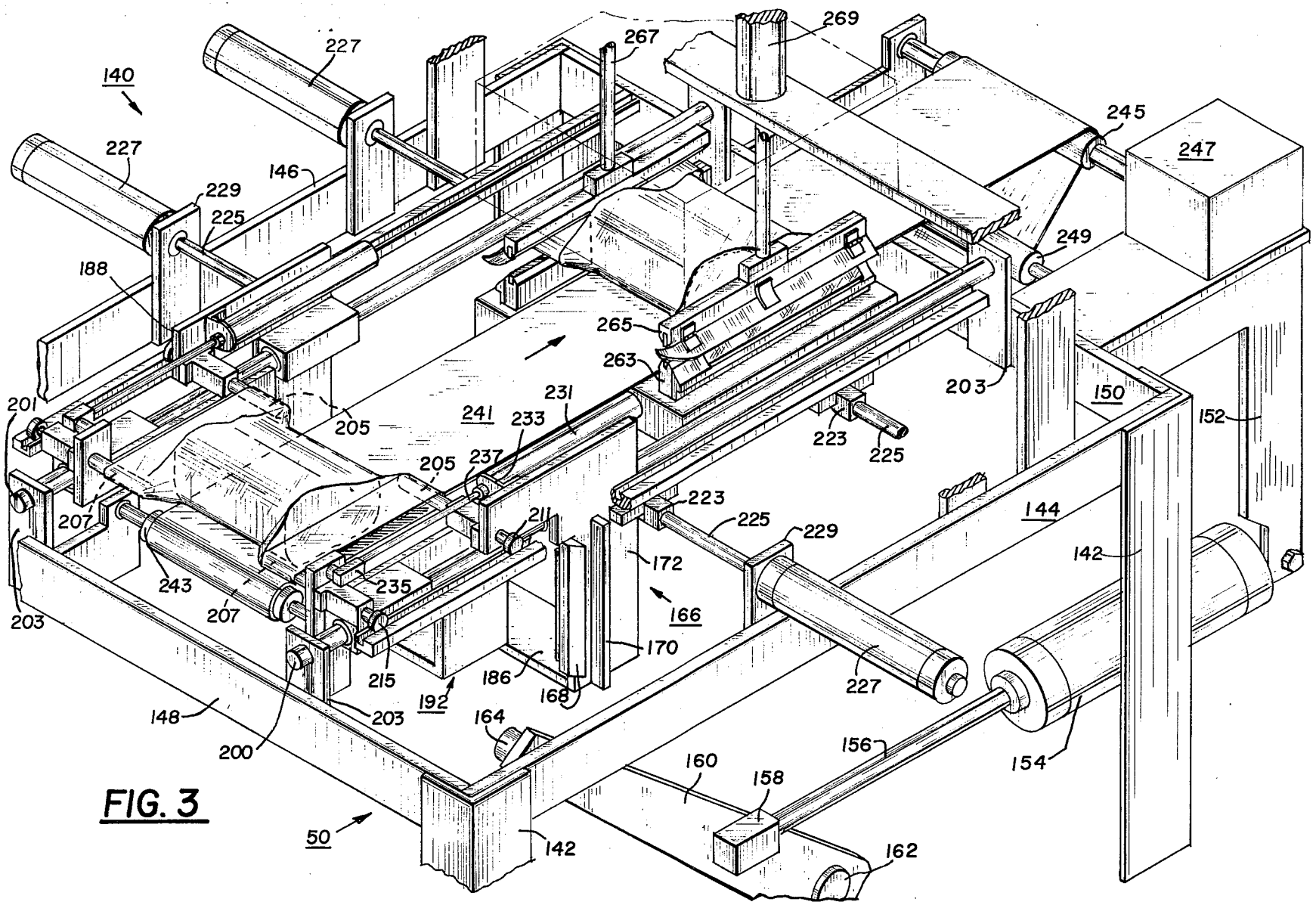
FIG. 3 represents an isometric view of the spreader bars and their actuation apparatus and components in combination with the package transfer and sealing apparatus.

Referring to the diagrammatic views of the film drape and article transfer apparatus of FIGS. 1 and 2, there is shown a lower web film feeding supply apparatus as carried on a frame 50, shown in FIG. 3. This film feeding supply apparatus is generally identified as 51. The lower film supply includes a roll of film 52 resting on a pair of cradle rollers 54 and from this roll the film leads to a first guide roller 56 and thence to and over a second guide roller 58. A pair of dancer arms 60 is pivotally carried by the frame and between the ends of these arms is a freely rotating dancer roller 62 which receives the film from the second roller 58. An actuator in the form of a pneumatic cylinder 64 carries a clevis 66 which is mounted on the end of piston rod 68 of the cylinder 64. A pivot pin 70 connects the dancer arms 60 to the clevis end 66. A deflector roller 72 provides the positioning of the lower extent of film as it is brought to a joining location with the upper film.

The upper film and feeding apparatus is generally identified as 75. Included in this apparatus, which is substantially a mirror arrangement of the bottom film supply, is upper film supply roll 77 which rests upon a pair of cradle rollers 79. The output of this roll is lead to and partly around a first guide roller 80 and then to and partly around a second guide roller 81. A pair of dancer arms 83 is pivotally carried by a support frame and these arms are limited in their downward movement by stop 84. A dancer roll 85 is carried between and by the arms which are moved by the dancer arm pneumatic cylinder 87. A clevis 89 is carried on the end of a piston rod 91 of cylinder 87. A pivot pin 93 secures the dancer 83 to the clevis member 89.

In operation the lower web of film is brought to a joining location with the upper film to provide a drape or curtain. The path of the lower web of film as it is lead over the several rollers is shown by the solid line 95. The path of the upper web of film is shown by the solid line 97. The two webs are joined at seam 99 to provide a drape or curtain of film which is in way of the path of the product to be wrapped.

Referring still to FIG. 1 there is depicted a product support member 101 shown at the left of the film seam 99. An air jet nozzle 103 as carried by the machine frame is shown. A nozzle is disposed on each side of the product support 101 and this nozzle is more-or-less in line with or near the edges of the web of film 95 and 97. The jets, when actuated, direct streams of pressurized air toward and into the drape of film to cause it to move downstream and encourages the ends to remain in an open condition. A product pusher member 105 is secured to the end of a piston rod 107 of a cylinder 109 which is carried by appropriate support means. When cylinder 109 is actuated the product is pushed into the curtain or drape of film.

Still referring to FIG. 1, a seam sealing station generally identified as 111 is provided with a pair of lower seal bars 113 which are held in a determined spaced relationship so that a knife 115 is slidable therebetween. These lower seal bars 113 are fixed to a suitable support or can be moved by an actuator means carried by the apparatus frame. The knife 115 is mounted in a clevis means 117 fastened to and carried at the end of a piston rod 119 of a knife actuating cylinder 121. A guide roller 123 is mounted to one of the lower seal bars so as to support and guide the drape of film as it is moved forwardly during the film wrap of the product and or by the blast from the jet nozzles 103.

A pair of spaced upper seal bars 125, each having sealing strips 126, is spaced and mounted so as to move into cooperative sealing relationship with the lower seal bars 113. These upper seal bars are mounted in and are carried by a support member 127 which is secured to and carried by the end of a piston rod 129 of an upper seal bar cylinder 131. The cylinder 131 is fastened to a frame portion of the apparatus. A guide roller 133 is mounted to and is carried by one of the upper seal bars and provides a change of direction for the upper film as it guides the drape of film as it is moved forwardly by the advancement of the product or blast of air. A pressure pad or plate 135 is fixedly mounted immediately above the pad and on the shaft is a compression spring 137. The upper end of the shaft carries a retaining ring 138 which limits the downward movement of the shaft 136. This shaft is journaled for longitudinal movement in block 139 which is mounted on support member 127. The movable pressure pad 135 is urged downwardly by the compression spring 137 and is limited in this downward movement by the retaining ring 138 which is above member 139.

Figure 4:
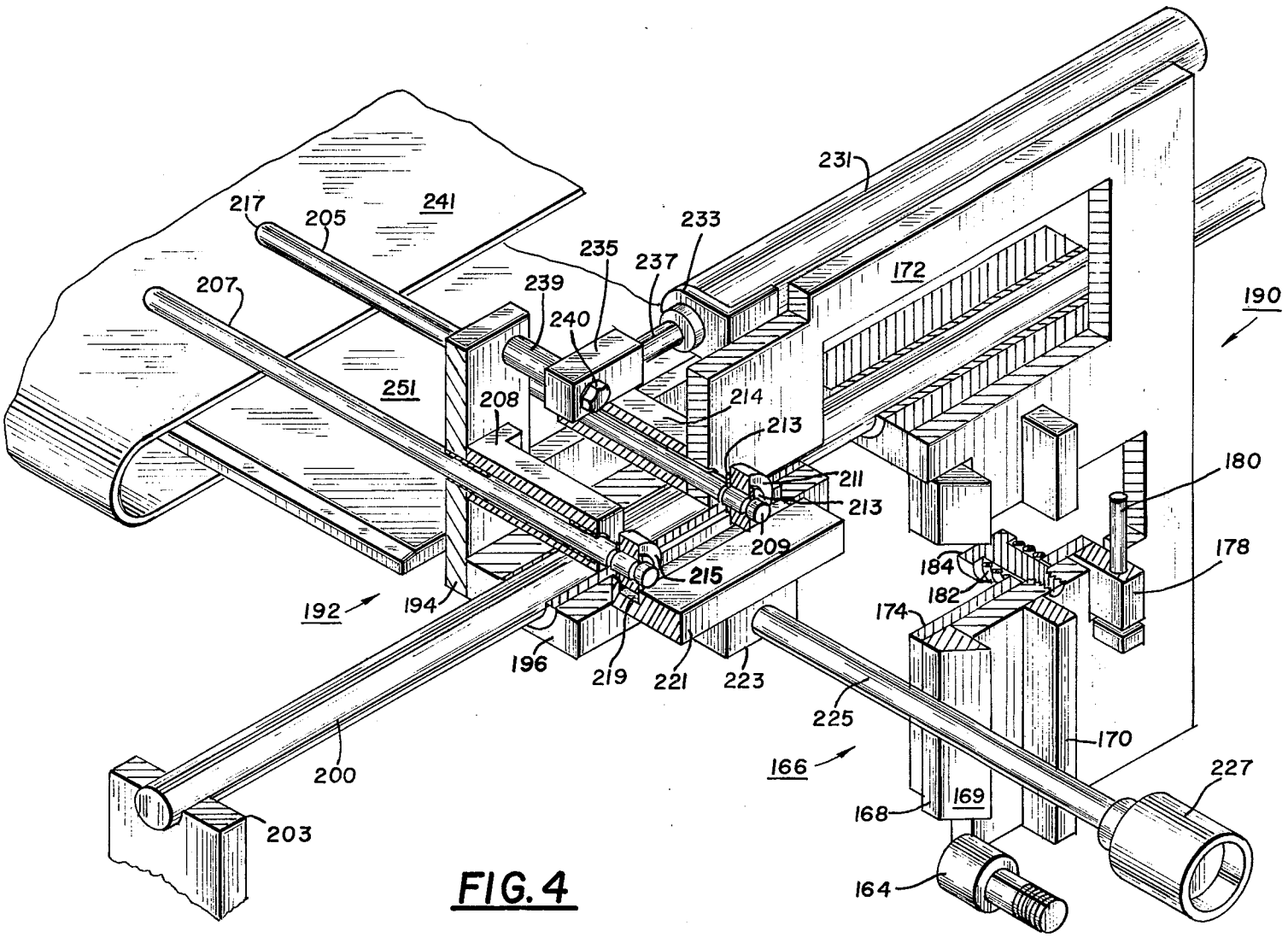
FIG. 4 represents a fragmentary, isometric view of the spreader probes and their pneumatic operating mechanism with portions in section and removed to show the relationship of the several components.

Referring to FIGS. 1 and 2, and for a fuller understanding of the apparatus for actuating the spreader bars reference is made to FIGS. 3 and 4. A package transfer station 140 includes a frame 50, as seen in FIG. 3, which is supported by legs 142 which may be of angle iron. Extending between these legs is a near-side horizontal member 144, a far-side horizontal member 146, a near end member 148 and a far end member 150. A motor support bracket 152 is fixedly attached to the far end member 150. An actuator which, as exemplified, is a pneumatic cylinder 154 is typically attached by its closed end to the bracket 152. Piston rod 156 associated with cylinder 154 is shown in the extended condition and on the end thereof is attached pivot block 158 which moves with rod. Cam arm 160 is pivotally mounted by pin 162 to the frame and is moved by the actuation of cylinder 154. Piston rod 156 which is affixed to the pivot block 158 is pivotally connected to the cam arm 160. A cam follower 164 which is an anti-friction bearing is rotatably carried at the swinging end of cam arm 160 and is sized to slidably fit in a cam track 166 during portions of the film and package transfer cycle. This cam track 166, as constructed, includes a short front member 168 which is maintained a spaced and determined distance from a longer rear member 170.

Referring particularly to FIG. 4, the long rear cam track member 170 is fixedly mounted to a side plate 172 while the shortened front cam track member 168 is fixedly mounted to a movable member 174. This movable plate-like member 174 is pivotally carried for movement inwardly toward side plate 172 by hinge block 178 and hinge pin 180. The hinge block 178 is fixed to movable member 174. The movable member 174 is urged outwardly to its cam following engaging position by a compression spring 182 which is mounted on and carried by a headed shoulder screw 184. This screw is mounted in a threaded hole in side plate 172. The side plate 172 is fastened to a cross member 186 (FIG. 3) and this cross member is fastened to a far side member 188 whose upper portion is like side plate 172. The side plate 172, the cross member 186 and the far side member 188 form the essential members of a primary carriage 190. A secondary carriage 192 includes a side member 194 and a base member 196. The primary carriage 190 and the secondary carriage 192 are slidably journaled on a near shaft 200 and a like far shaft 201. These shafts are supported at both ends by support brackets 203.

As seen in FIGS. 1, 2, 3 and 4, a spreader probe or bar 205 is slidably journaled and carried by near side plate 172 and an oppositely disposed probe 205 is journaled and carried in far side member 188. Companion spreader probes or bars 207 are slidably journaled in a bearing pedestal 208 carried by plate 194 on the near side and in a mirror arrangement on the far side. On the near end 209 of probe 205 is mounted a roller bearing 211. This roller bearing is retained in place by retaining rings 213 carried in grooves formed in the near end portion of probe 205 which is carried in pedestal 214. A second roller bearing 215 is retained on the near end of spreader probe 207 and by means of snap rings is maintained in place in a manner similar to that of the roller bearing on probe 205. The inwardly directed ends of all are rounded as indicated at 217 to provide for smooth entry and withdrawal.

Roller 211 and roller 215 are carried in and ride in a track 219 formed in an elongated bar 221. This bar is supported by a pair of blocks 223. Each block 223 is fastened to the end of a piston rod 225 of a pneumatic cylinder 227. On the near side, as in FIG. 3, only one cylinder 227 is shown but on the far side a pair of cylinders 227, which carry and move the bar 221, is shown. Each cylinder 227 is secured to and carried by a bracket 229 which is mounted to the frame.

Spreader probe 205 and 207 are moved along shaft 200 and 201 by pneumatic cylinders 231 which are each mounted to a side plate by brackets 233. On the near side the plate is identified as 172 and on the far side is identified as plate 188 as seen in FIG. 3. An attachment block 235 is carried by and is fastened to the piston rod 237 of the cylinder 231. This attachment block 235 is secured in a spaced relationship to the secondary carriage 192 by a spacer 239 and by a hex head bolt 240 mounted in plate 194.

Referring now to FIGS. 1, 2 and 3, a conveyor belt 241 is supported at one end by a freely turning roller 243 and at the delivery end of the machine by a drive roller 245. This drive roller is rotated by a drive means identified as 247 and mounted on bracket 152. An idler roller 249 is mounted to the frame 50 and is positioned below and intermediate the front and drive rollers 243 and 245. The upper extent of the belt 241 is supported by a stationery plate 251 at the foreportion and at the rear portion by a final seal station mounting plate 253.

Referring particularly to FIGS. 1 and 2, an end seal station, generally identified as 255, includes seal station mounting plate 253 and upper vacuum chamber actuating cylinder 257 which is carried by the mounting plate 253. An upper vacuum chamber 259 is fastened to piston rod 261 of the cylinder 257 and is raised and lowered by the actuation of the cylinder. A lower seal bar 263 is mounted to and carried by the mounting plate 253. An upper seal bar 265 is secured to and carried by a piston rod 267 of a seal bar actuating cylinder 269. The seal bar cylinder 269 is fastened to and carried by the machine frame while the piston rod 267 is journaled in the upper vacuum chamber 259. A pair of valves control the interior of the closed chamber. A valve controls the flow in conductor 273 which leads to a source of vacuum. A second valve 275 is ported to atmosphere. A conductor or pipe 276 carries the vacuum or atmosphere to the interior of the closed chamber.

SEQUENCE SHOWN IN FIGS. 5*A* THROUGH 5*F*

Referring next to the sequence of package forming and sealing as shown in the partial sectional views in FIGS. 5*a*, 5*b*, 5*c*, 5*d*, 5*e* and 5*f*, there is depicted, in enlarged scale, the upper portion 259 which with the mounting plate 253 forms the chamber. A gasket 277 is carried on the downwardly extending edge of the upper portion of the vacuum chamber 259 so that when and while in the closed condition of FIGS. 5*c*, 5*d* and 5*e* the chamber is sealed to the flow of gases except through pipe inlet conductor 276. The lower seal bar 263 has a resilient insert 279 which insert is more-or-less centrally positioned in member 263. A downwardly directed package mouth support 281 is secured to and carried by bar 263. The upper seal bar 265 is contemplated to be made of insulating material and intermediate its width and on the bottom surface thereof is a film sealing means 283 which may be a resistance ribbon. A plow member 285 is hinged to the upper seal bar 265 and is urged to and toward the shown downward position of FIG. 5*a* by a leaf spring 287.

OPERATION OF THE PREFERRED APPARATUS

Figure 18:
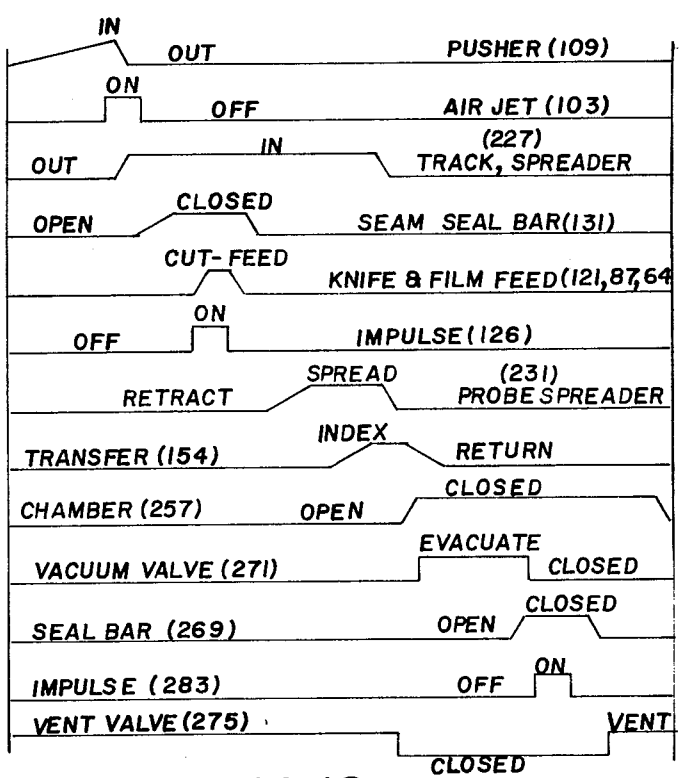
FIG. 18 represents a timing cycle diagram for one machine cycle to form a complete package around a product showing the preferred apparatus.
Figure 19:
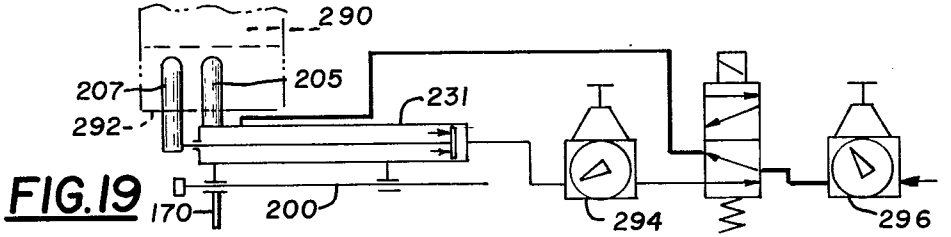
FIG. 19 represents a schematic view depicting the spreader probes and the associated control components such as a solenoid valve and pressure regulators by which equal apart pressure on the film is applied to each of the probes.

As above shown in FIGS. 1 and 2 and also as shown in the timing diagram of FIG. 18, initially a seam 99 is made joining the upper film 97 to the lower film 95 to form a drape or curtain. The film for the package is preferably of a barrier material laminated to an Iolon (Trademark of E. I. duPont) sealing surface. The initial seam 99 is made by pulling the free ends of the film through the seam sealing station 111 and actuating the seam seal system including upper and lower bars 126 and 113. The detailed operation of the seam sealing system as a portion of the packaging sequence is described hereinafter in the operation description.

Figure 9:
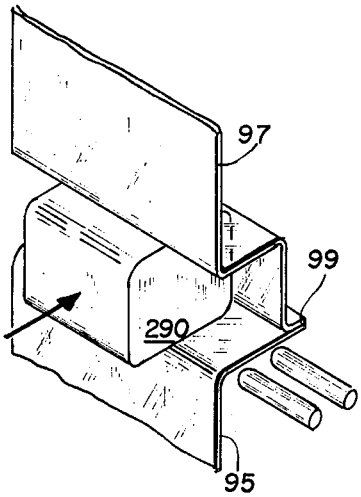
FIGS. 9 through 17 represent isometric views, partly diagrammatic, of the product and film and the resulting stages of the package as found during several of the sequential operations performed by the apparatus.
Figure 11:
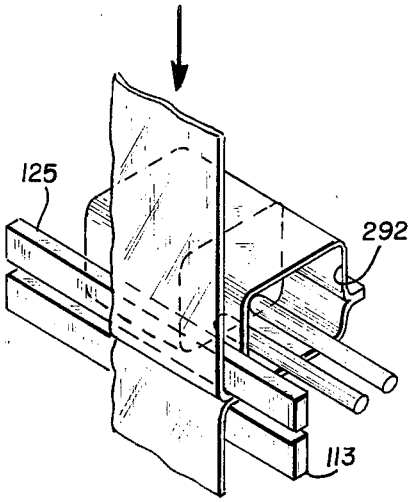

With the curtain of film formed by webs 95 and 97 the dancer arm cylinders 64 and 87 are relieved of pressurized air so that film 95 and 97 may be drawn from the film stored with the downward movement of the dancer arms 60 and 83. Product 290, as seen in FIGS. 2 and 9, is placed on the product support 101 between the curtain of film and the product pusher 105. Cylinder 109 is energized to move the pusher and the product 290 into the curtain of film. The advance of the product is stopped by a signal device, not shown, so that the trailing edge of the product is at a predetermined point which is ahead of the forward bars 113 and 126 of the transfer station 140. When and after the product is in this transfer position the upper seal bar cylinder 131 is pressurized for downward movement carrying the upper seal bar 125 downward and with lower seal bar 113 seals the film 95 and 97 to form a new seam 99 and seal the film into a tube around the product. Pressure pad 135 clamps the film to the product as a film wrapped product, identified as 291, formed. As seen in FIG. 2 this close fitting sleeve completely envelopes the product 290 and, as seen in FIG. 11, has package mouths 292.

The upper seal bars 125 have their sealing strips 126 heated at this point. The heating ribbons may be impulse resistant ribbons. During the seam forming operation the knife 115 is moved upwardly by the cylinder 121 cutting the film between the pair of seams 99 made during the sealing operation. With film 97 and 95 clamped by seal bars 125 and 113 the upper film feed system 75 and cylinder 87 are energized to cause the dancer arm 83 to move downward. Film is pulled from supply roll 77 by the downward movement of roller 85 until the dancer arm 83 reaches a limit stop 84 which may be adjustably positioned. Lower film feed system 51 is actuated at the same time and in the same manner to cause a determined supply of film to be drawn from the roll 52 by the downward movement of dancer arm 60 and roller 62.

Figure 10:
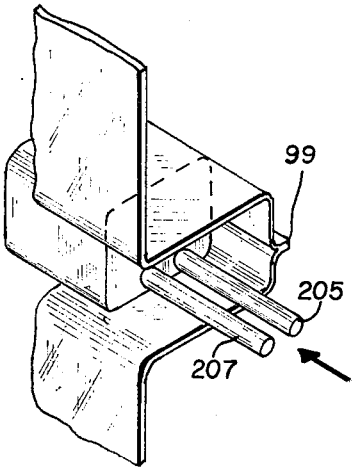

Prior to the actuation of the upper seam seal bar cylinder 131 a jet of air is fed through the nozzles 103 to maintain the edge of the film in an open U-shaped condition for easy entry of the spreader probes 205 and 207. This entry of the probes is seen in FIG. 10 wherein these probes are shown as entering the film before forming into the package 291. Cylinders 227 move the elongated bar 221 to provide this inward movement of the probes.

CENTRALIZING ACTUATION OF THE PROBES

Figure 14:
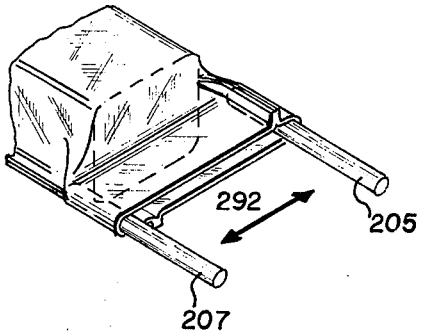
Figure 20:
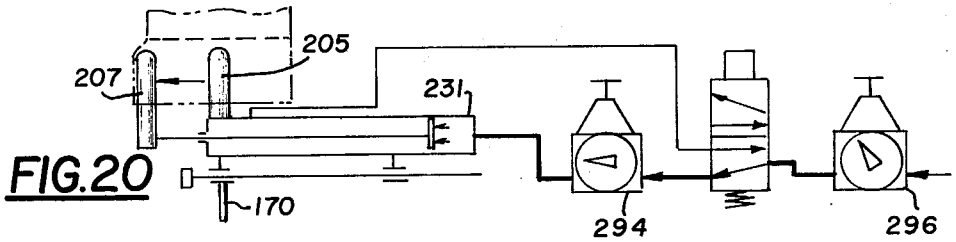
FIG. 20 represents the schematic view of the apparatus of FIG. 19 during the initial stages of spreader probe insertion into the flm tube.
Figure 21:
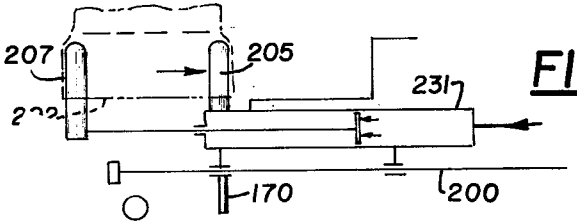
FIG. 21 represents the schematic view and apparatus of FIG. 20 with the probes moved into partial spreading condition.
Figure 22:
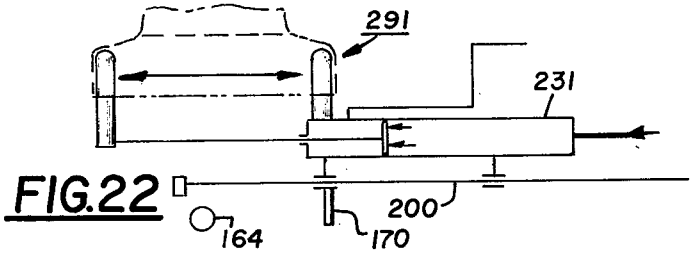
FIG. 22 represents the schematic view of the apparatus of FIG. 21 with the spreader probes fully and substantially equally spreading the end of a film tube under the influence of an equal pneumatic force.
Figure 23:
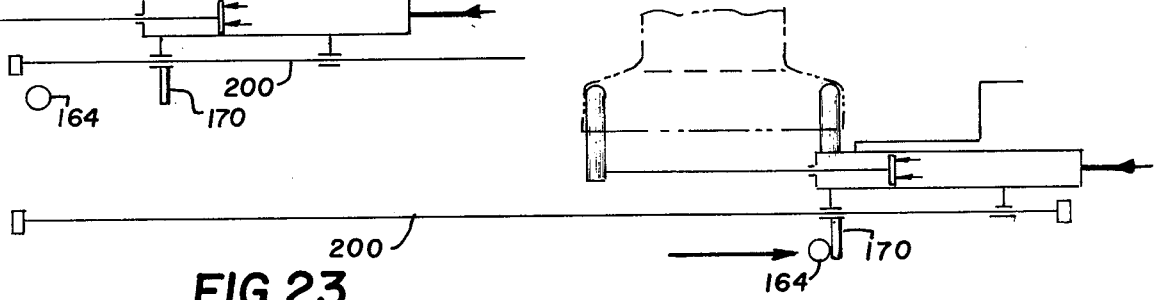
FIG. 23 represents the schematic view of the apparatus of FIG. 22 with the package and spreader probes transferred to the chamber position.

Referring to FIGS. 1 through 14 and FIGS. 18 through 23, it is to be noted that when the pneumatic cylinder 231 is energized the spreader probe 207 is urged forwardly against the left side of the package mouth 292. When the forward progress of the probe is resisted by the edge of the package mouth 292 as in FIGS. 11, 12 and 20, the spreader probe 205 is urged rightwardly to engage the right edge of the package mouth 292, as shown in FIGS. 13 and 21, until the package mouth is completely spread, as shown in FIGS. 14 and 22. The antifriction movement of the members 172 and 188 along the shafts 200 and 201 enable this simple and effective self-centering of the probes to occur. So as to not tear or destroy the seam 99 at the package mouth 292, the force and speed of impact of the spreader probes 205 and 207 are controlled by a secondary low air pressure regulator 294 which is adjusted to accommodate the various types of film used for packaging. During this expanding and self-centering operation the spreader probes 205 and 207 are maintained in the inserted position and condition by the track 219 as it engages and retains the rollers 211 and 215.

Figure 15:
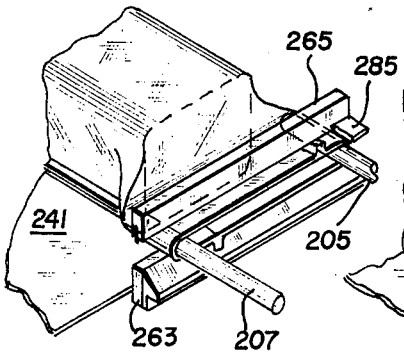

During the insertion and spreading of the probes in the end 292 of the package the frame on which the probes are carried on shafts 200 and 201 are relatively free to move in accordance with the developed resistance in the mouth of the package. After the package mouth has been fully spread, the transfer actuating cylinder 154 is energized causing the arm 160 to pivot. Reference is now particularly made to FIGS. 1, 4 and 18. It is to be further noted that the position of cam track 166 will vary with the amount of relative motion between the spreader probe 205 and spreader probe 207 as a result of variations in package size. Since the opening of the cam track will not necessarily line up with the arc of the cam follower 164, as carried on the arm 160, the hinged short member 168 of the cam track assembly 166 is provided. As the arm 160 is moved in an arc clockwise, the cam follower 164 approaches and then engages the inclined surface 169 of the short member 168 causing the short member to move inwardly against the bias of spring 182 until the follower 164 enters the track 166 and engages the long member 170. The short member returns to its position of FIG. 4 under the influence of the spring 182 and with the follower in the track the further movement of the arm 160 causes the package and inserted probes to be transferred to the final seal station 255, as shown in FIGS. 2 and 15.

Figures 5A, 5B, 5C, 6A, 6B, 7A, 7B, 8A, 8B:
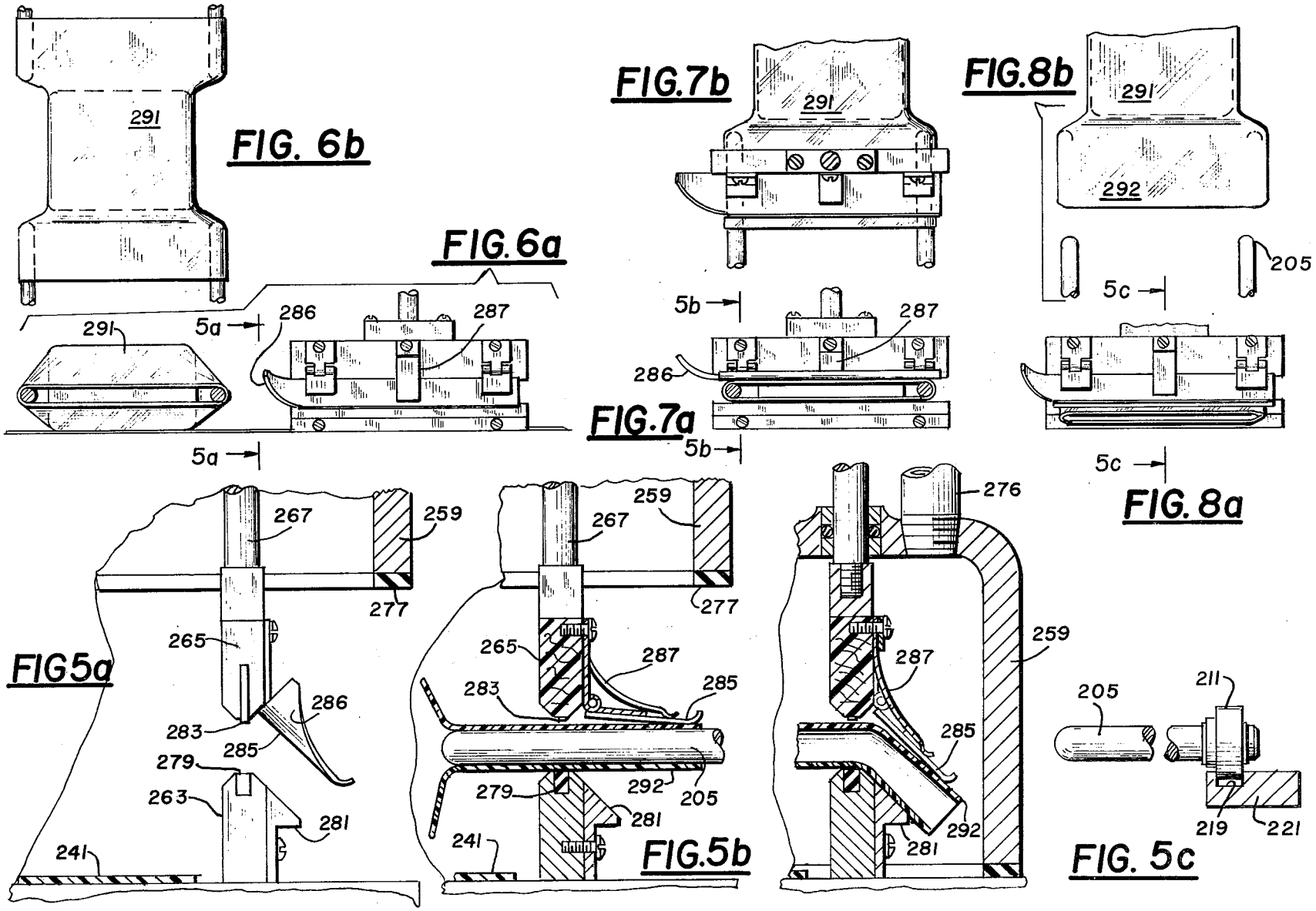
FIG. 5*a* represents in a slightly enlarged scale a sectional, fragmentary view of the vacuum chamber and seal bars prior to the presentation of a tubular film wrapped package.
FIG. 5*b* represents a sectional, fragmentary view of the vacuum chamber of FIG. 5*a* after a tubular wrapped package is positioned within the chamber and showing the spreader probes in place in the end of the package.
FIG. 5*c* represents a sectional, fragmentary view of the vacuum chamber of FIG. 5*a* but with the chamber in closed condition, the spreader probes moved from the package and outside the chamber but with the seal bar members in open condition.
FIG. 6*a* represents a somewhat diagrammatic side view of the package with a pair of spreader probes entered and moved apart in one end of the tubular film and adjacent thereto the seal bars for closing this elongated tubular opening.
FIG. 6*b* represents the plan view of the tubular film and product as shown in FIG. 6*a;*
FIG. 7*a* represents a side view of the seal bars of FIG. 6*a* as they are held apart for the slidable entry therebetween of the elongated open end of the tubular film as held apart by the spreader probes, this view taken prior to the clamping and sealing of the end of the film.
FIG. 7*b* represents a plan view of the package as wrapped and as shown in FIG. 7*a;*
FIG. 8*a* represents a side view, partly diagrammatic, with the spreader probes withdrawn and the seal bars as they close the stretched ends of the package after evacuation and just prior to sealing the end of the tubular film.
FIG. 8*b* represents a plan view of the package as wrapped and as shown in FIGS. 8*a*, this view showing the spreader probes retracted from the mouth of the tubular film.

In FIGS. 5*a* and 6*a* the chamber is shown in an open condition with the seal bars open and no package yet transferred therebetween. In FIG. 6*b* is seen the package 291 with the probes in both open ends of the film wrap. In FIGS. 5*b*, 7*a* and 7*b* the wrapped package 291 is shown as transferred to the sealing position with the probes 205 and 207 still in place. The package mouth 292 is now between the upper seal bar 265 and the lower seal bar 263. The gap between the upper seal bar 265 and the lower seal bar 263 is selected or established so that a clearance of approximately one-eighth of an inch clearance is maintained over the thickness or diameter of the probes 205 and 207. As the spreader probe and mouth 292 enter the space between the seal bars they engage the curved cam forward surface 286 of the hinged plow 285 and lift this plow upwardly to the position seen in FIG. 5*b* and also in the view of FIGS. 7*a* and 7*b*.

Referring next to FIGS. 5*c*, 8*a*, 8*b* and FIG. 16, it is to be noted that at the end of the transfer of the package the spreader probes are removed and, as depicted in these views, as the probes are moved from the opening in the film wrap by the actuation of cylinders 227 a release of the spreading force on the opening 292 occurs. These probes are moved toward each other by the release of the pressure in clyinder 231. The outward movement of the track 219 pulls the rollers 211 and 215 and the attached probes 205 and 207 out of the mouth of the film wrap and also from the chamber area. With the withdrawal of the probes the plow 285 returns to its original biased down position in a spaced relationship to the mouth support member 281. The upper vacuum chamber 259 is now moved downwardly by the cylinder 257. With the chamber now closed and substantially sealed, the vacuum valve 271 is opened to a source of vacuum thereby reducing the pressure inside the chamber 259 and also in the sleeved package 291.

Figure 5F:
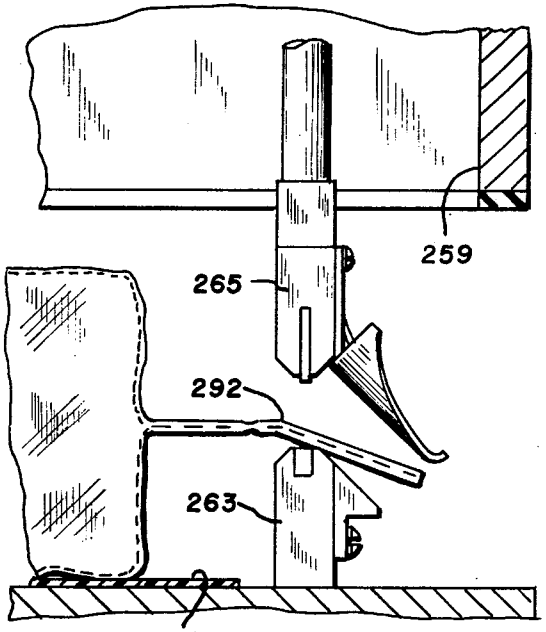
FIG. 5*f* represents a sectional, fragmentary view of the vacuum chamber of FIG. 5*e* after venting of the chamber and with the upper chamber portion raised to permit transfer and removal of the now completed package.
Figure 5E:
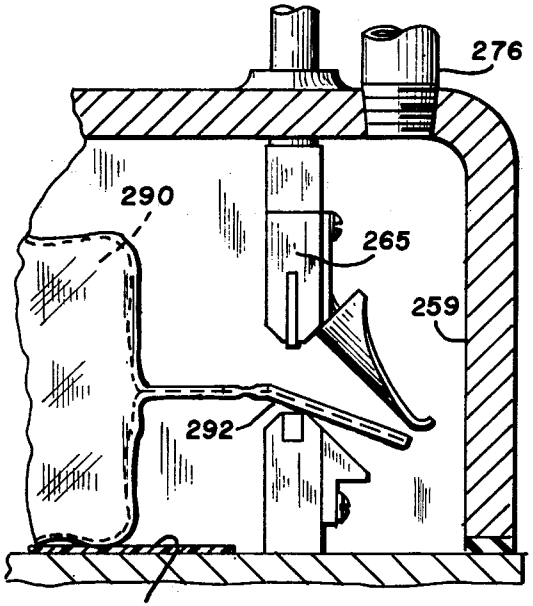
FIG. 5*e* represents the sectional, fragmentary view of the vacuum chamber of FIG. 5*d* during venting of the chamber and with the seal bars now separated.
Figure 5D:
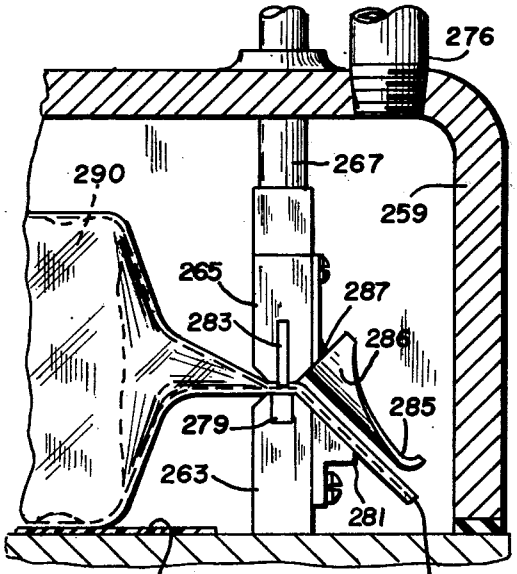
FIG. 5*d* represents a sectional, fragmentary view of the vacuum chamber and package of FIG. 5*c* after the chamber evacuation and showing the sealing of the elongated ends of the packages.
Figure 17:
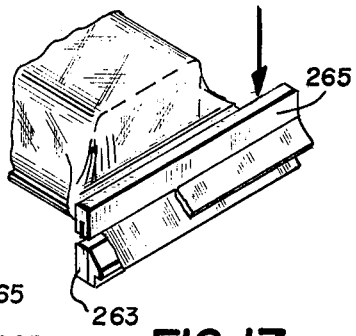

Reference is now made to FIG. 5*d* in which is depicted the closed chamber and when the pressure in the chamber and the package has been reduced to a desired level the upper seal bar 265 is urged downward by the actuated cylinder 269, as seen in FIG. 17. After the desired clamping pressure has been exerted the impulse sealing means 283 is actuated effecting a sealing of the film layers at the package mouth 292.

After the seal has been made by the upper seal bar 265 the bar is returned to its upper position by cylinder 269, as seen in FIG. 1. The vacuum valve 271 is closed and the vent valve 275 is opened to the atmosphere. This condition in the chamber is represented in FIG. 5*e*. After the venting cycle is completed the vacuum chamber top 259 is raised as seen in FIG. 5*f*.

During the evacuation cycle the spreader probes 205 and 207 and their carriages 190 and 192 are returned to position 140, as shown in FIG. 1. At the end or near the end of this sequence of operation the cam follower 164 may exit the cam track 166. This occurs when the follower reaches the lower end of the shorter member 168. With the cam follower disengaged from the track 166 and carriage 190 the spreader probes 205 and 207 are free to center themselves in the package mouth 292 when the next spreading cycle begins. After the vacuum chamber is raised the conveyor belt 241 is moved by the drive means 247 and carries to the delivery conveyor 299 the complete package 300 which is packed for delivery in a normal manner.

The apparatus, above described, in combustion with the drawings show a package in which the film is formed into a tubular bag open at both ends and with the product placed therein. The ends are stretched to form mouth-like portions at each end of the tubular wrap. The probe members are self-centering and are regulated in their stretching force to accommodate the film being used. Whether the package is sealed under vacuum utilizing a hermetic seal or simply a flat seal for the package which is to be frozen or kept under refrigeration is merely a matter of selection. The package is formed with the elongated mouth portions enabling smooth seals to be made without wrinkles. This is an essential part of this invention.

Figure 12:
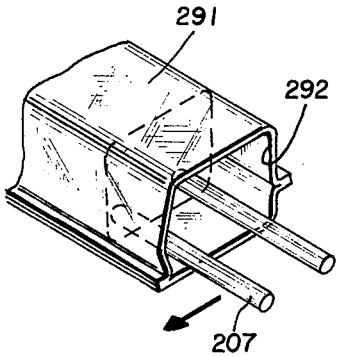
Figure 13:
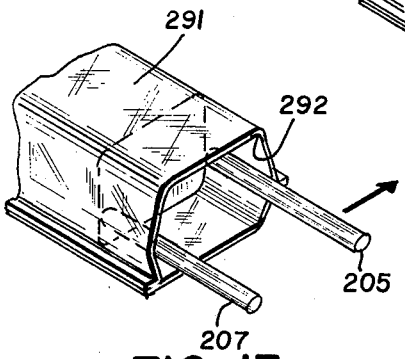
Figure 16:
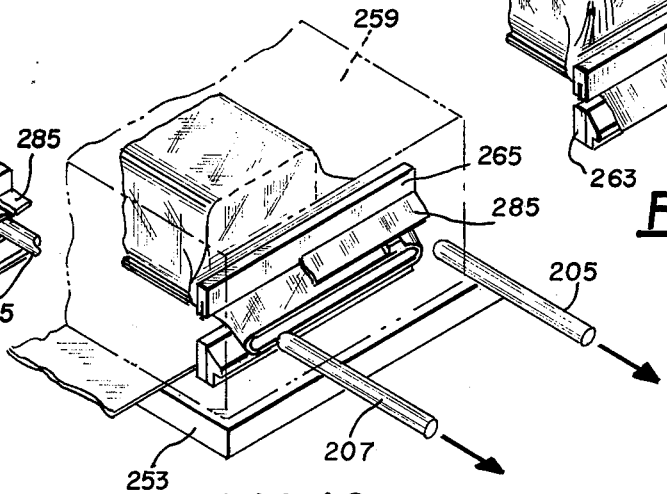

As a method the sequence is shown in the diagrammatic steps depicted in FIGS. 9 through 17. In FIG. 9 the film drape is provided and the product is advanced into the drape. In FIG. 10 the probes have been moved into the film end and adjacent the product prior to the sealing of the film drape, as shown in FIG. 11. After the seam is formed, the knife cuts the film and leaves a drape portion and the tubular film wrap, as seen in FIG. 12. It is to be noted that the seam may be mid-height of the package or at the bottom near the conveyor belt level. The right seam is shown near mid-height and the left seam is near the bottom of the package. The probe 207 approaches the left edge of the package mouth 292 and after engaging the film and meeting resistance the probes 205 moves rightward, as seen in FIG. 13, and under the influence of low pressure air in a cylinder 231 both probes move substantially equal distances from the theoretical center line of the package or tube of film. This is depicted in FIG. 14. With the probes still in stretching condition the enveloped product is advanced on belt 241 and by arm 160 to and between upper and lower seal bars 265 and 263, as shown in FIG. 15. In FIG. 16 the probes are withdrawn from the package mouth 292 and the chamber 259 is brought to a closed condition and subsequently preferably to a condition of reduced pressure. With or without the vacuum treatment the seal bars 265 and 263 are actuated to seal the end of the film, as seen in FIG. 17.

As a product the package includes a product of a size that is not conveniently wrapped by skin packaging. A tubular film preferably is formed around the product but could be cut-to-length tubular film with the product placed therein by entry through one end. After the product is placed within the tube the ends are entered by spreader probes which lightly stretch the film and form elongated narrow openings at each of the ends of the tubular film. The expansion pressure of the probes are removed and the probes are withdrawn from the entrance or mouth of the film wrap. The sealing means is immediately employed to close and seal each end of the tubular film.

It is also realized that the film could be a heat shrink film which would require a heat tunnel or the like. The film wrapped package shown described above does not overstretch the film in its forming since regulators are available to move the cylinders which shape the package and seal the ends of the wrap.

It is to be noted that the hinged plow 285 shown carried by the upper sealing means 265 is not needed with many films. Where the resulting seal causes the adjacent film to move more-or-less togehter the plow is not required. The plow merely insures that the resulting package is neat and the extending end portions result in a substantially overlaid relationship.

Terms such as "left", "right", "up", "down", "bottom", "top", "front", "back", "in", "out", "clockwise", "counterclockwise" and the like are applicable to the embodiments shown and described in conjunction with the drawings. These terms are merely for the purpose of description and do not necessarily apply to the position in which the method, product and apparatus may be constructed or used.

While a particular embodiment of the packaging apparatus has been shown and described it is to be understood the invention is not limited thereto since modifications may be made within the scope of the accompanying claims and protection is sought to the broadest extent the prior art allows.

What is claimed is:

1. A package apparatus for large products which may have irregular surfaces and voids, the apparatus utilizing a film which has sealing capabilities, said apparatus including: (a) means for providing and delivering to a product enclosing station a tubular portion of film open at both ends; (b) means for placing a product to be packaged in this tubular film with and while both ends of the film are in open condition; (c) means for positioning oppositely disposed pairs of spreader probes so that each pair is in an open end of a tubular film, the pair of probes in a close together condition and to a position near the end of the product as placed in the tubular film, each pair of probes carried in a probe support means freely movable on a track and with entry of the spreader probes in this close together condition into the open end of the tubular film; (d) means for disconnecting the probe support means so that the probes as carried by this means are free to move along the track; (e) means for moving the spreader probes apart after entering the ends of the tubular film, the free movement of the probes allowing one probe to engage the inside of the tubular film whereupon the other probe begins movement to provide a self-centering in the tubular end of the film and to cause the ends of the film to be formed into narrow mouths, with these mouth openings and the spreader probes being substantially equal distant from the theoretical center line of the tubular film; (f) means for limiting the apart movement of each pair of spreader probes so as to produce a controlled stretch and force to each of the tubular ends of the film; (g) means for releasing the apart force on the probes and for withdrawing the spreader probes from the stretched elongated ends of the tubular film; (h) means for sealing the elongated openings of the tubular film as and after the probes have been at least partially removed from the ends of the film, and (i) means for removing the now packaged product from the apparatus.

2. A packaging apparatus as in claim 1 in which during the sealing of the package vacuum is provided to condition the product which may be a subprimal of meat and the film has heat sealing properties and the sealing of the film is by heat sealing.

3. A packaging apparatus as in claim 1 in which the packaging is under the influence of vacuum and includes additional apparatus among which is means for transporting and placing the product and the inserted probes while in the tubular film within a selectively closable vacuum chamber and closing said chamber after the withdrawing of the probes from the ends of the tubular film, and there is provided heat sealing means for closing the ends of the tubular film, these ends of the film remaining open to the interior of the chamber while maintained between the heat sealing means and with the ends of the film free of wrinkles as the chamber and enclosed product is brought to a condition of reduced pressure, means for actuating the heat sealing means to seal the ends of the tubular film while the chamber is in a condition of reduced pressure and means for bringing the chamber to atmospheric pressure prior to the opening of the chamber and removal of the now heat sealed vacuum packaged product from the apparatus.

4. A packaging apparatus as in claim 3 in which forming the tubular film wrap includes means for forming a drape of film by sealing upper and lower film strips as supplied from rolls and means for advancing the product into this drape sufficiently to enclose the forward face top and bottom of the product and by appropriately disposed and actuated sealing means causing a seal of the trailing portions of film strips to be made and means for severing the strips from the formed tubular film around the product.

5. A packaging apparatus as in claim 4 in which the transport of the film encased product and the apart spreader probes in the tubular film ends are substantially simultaneously performed, the transfer of the pair of probes being by the movement of an arm having a cam follower which engages the face of a rear cam member associated with a carriage on which the probes are supported and with and by the movement of said arm this carriage is moved.

6. A packaging apparatus as in claim 5 in which the carriage on which the probes are carried has a short front cam shoulder member which is engaged by the roller on the arm for return movement of the carriage to the product encasing station before the entry of the probe into the ends of the film wrap, the cam track provided by the front and rear cam members adapted to disengage from the roller before the apart movement of the probes.

7. A packaging apparatus as in claim 6 in which each pair of probes as mounted on the carriage is movable along a track means and the probes are carried by rollers in a manner so that they are moved apart by a pneumatic cylinder which is arranged to move both probes with equal force against the opposite sides of the end of a tubular film.

8. A packaging apparatus as in claim 7 in which the outer ends of the probes are carried by and secured to rollers carried in a track formed in an elongated bar and in which this bar is movable by selectably actuated means to inner and outer limits to provide the extremes of inner and outer positioning of the probes.

9. A packaging apparatus as in claim 8 in which the heat sealing means in the vacuum chamber includes upper and lower seal bars with the upper bar selectively movable from an open condition to a heat sealing closed condition by an actuating cylinder.

10. A packaging apparatus as in claim 9 in which the lower seal bar carries a package mouth support which guides the film downwardly and outwardly and the upper seal bar carries a hinged plow member which is swung outwardly by the spreader probes in the package ends and with the withdrawal of the spreader probes the plow is moved to a position substantially parallel to the package mouth support guide surface so that at the sealing of the ends of the film that portion of the film outwardly of the seal is brought close together.

11. A method for packaging large products which may have irregular surfaces and voids, the method utilizing a film which has sealing capabilities, said method including the steps of: (a) providing and delivering to a product enclosing station a tubular portion of film open at both ends; (b) placing a product to be packaged in this tubular film with and while both ends of the film are in open condition; (c) positioning oppositely disposed pairs of spreader probes so that each pair of probes enter an open end of a tubular film, the pair of probes in a close together condition and to a position near the ends of the product; (d) carrying each pair of probes in a probe support freely movable on a track and with entry of the spreader probes in the close together condition into the open end of the tubular film; (e) disconnecting the probe supports so the probes are free to move along the track; (f) moving the spreader probes apart after entering the ends of the tubular film, the free movement of the probes allowing one probe to engage the inside of the tubular film whereupon the other probe begins movement to provide a self-centering in the tubular end of the film and to cause the ends of the film to be formed into narrow mouths, with these mouth openings and the spreader probes being substantially equal distant from the theoretical center line of the tubular film; (g) limiting the apart movement of each pair of spreader probes so as to produce a controlled stretch and force to each of the tubular ends of the film; (h) releasing the apart force on the probes and withdrawing the spreader probes from the stretched elongated ends of the tubular film; (i) sealing the elongated openings of the tubular film as and after the probes have been at least partially removed from the ends of the film, and (j) removing the now packaged product from the apparatus.

12. The method of packaging large products as in claim 11 which includes the further step of bringing the package and contents to a condition of reduced pressure during the forming and sealing of the package and further includes furnishing a film which has heat sealing properties and sealing this film by heat.

13. The method of packaging large products as in claim 11 which includes the further step of transporting and placing the film encased product and stretched end openings with the apart probes therein in a selectively closable vacuum chamber and closing said chamber after withdrawing the spreader probes from the tubular film and maintaining the elongated narrow opening in the ends of the tubular film and further evacuating the closed chamber to bring the interior of the chamber and the package to a condition of reduced pressure and while in this condition actuating the heat sealing means to seal both ends of the tubular film and then the step of bringing the chamber to atmospheric pressure and opening the chamber and removing the now heat sealed vacuum packaged product.

14. The method of packaging large products as in claim 13 which includes the further steps of forming the drape of film by sealing upper and lower film strips as supplied from rolls and the further tep of advancing the product into this drape of film sufficiently to enclose the forward face, bottom and top of the product and by the further step of actuating sealing apparatus causing a seal of the trailing portion of film strips to be made and severing these strips from the formed tubular film now around the product.

15. The method of packaging large products as in claim 14 which includes the further step of transporting the film encased product and the apart spreader probes positioned in the ends of the tubular film at substantially the same time, the transporting of the probes including the step of engaging and moving the carriage on which the probes are supported as they are moved into and from the ends of the film.

16. The method of packaging large products as in claim 1 which includes the further step of mounting each pair of probes on a carriage movable along a track and on rollers and moving the probes apart by a pneumatic cylinder so that both probes are brought against opposite sides of the same end of the tubular film.

17. The method of packaging large products as in claim 16 which includes the further step of carrying the outer ends of the probes on rollers which are carried in a track formed in an elongated bar and moving this bar by selectively actuated means to inner and outer limits to provide the extremes of inner and outer placement of the probes.

* * * * *